United States Patent [19]

Steinberger

[11] Patent Number: 4,625,613

[45] Date of Patent: Dec. 2, 1986

[54] ADJUSTABLE BRIDGE AND TUNING UNIT FOR A STRINGED MUSICAL INSTRUMENT

[75] Inventor: Ned Steinberger, Cornwall, N.Y.

[73] Assignee: Steinberger Sound Corporation, Newburgh, N.Y.

[21] Appl. No.: 596,671

[22] Filed: Apr. 4, 1984

[51] Int. Cl.[4] ..... G10D 3/04

[52] U.S. Cl. ..... 84/298; 84/267; 84/304

[58] Field of Search ..... 84/267, 297 R, 298, 84/299, 307, 312, 313

[56] References Cited

U.S. PATENT DOCUMENTS

| | | | |
|---|---|---|---|
| 2,070,916 | 2/1937 | Peate | 84/297 R |
| 3,178,985 | 4/1965 | Jeranson | 84/307 |
| 4,160,401 | 7/1979 | Tomioka | 84/1.16 |
| 4,385,543 | 5/1983 | Shaw et al. | 84/298 |
| 4,453,443 | 6/1984 | Smith | 84/298 |
| 4,457,201 | 7/1984 | Storey | 84/313 |
| 4,506,585 | 3/1985 | Desmond | 84/298 |

*Primary Examiner*—Lawrence R. Franklin
*Attorney, Agent, or Firm*—Finnegan, Henderson, Farabow, Garrett & Dunner

[57] ABSTRACT

An adjustable bridge and tuning unit for a stringed musical instrument, the instrument including a body, a neck portion extending from the body, a plurality of strings extending over a part of the body and the neck portion, and means for securing the strings at one end to the neck portion, the bridge and tuning unit comprising a base member fixedly mounted to the body, the base member including a pair of sidewalls defining a channel therebetween; a plurality of individual bridge saddles, one of the bridge saddles corresponding to and aligned for supporting each of the strings, each said saddle generally comprising a rectangular paralleli piped, and having a groove on one surface thereof for alignment with the string. The bridge saddles are positioned in abutting relation within the channel and one of the saddles is in frictional contact with one of the sidewalls. A threaded member is provided for individually adjusting the position of each bridge saddle longitudinally in the direction of the string, and only a single screw is provided for adjusting the position of each of the bridge saddles generally vertically with respect to the base member. A tuning mechanism mounted on the base member secures the other end of each string and increases or decreases the tension in each string.

10 Claims, 6 Drawing Figures

ADJUSTABLE BRIDGE AND TUNING UNIT FOR A STRINGED MUSICAL INSTRUMENT

FIELD OF THE INVENTION

This invention relates to adjustable bridges for stringed musical instruments. More particularly, the invention relates to bridges with individually adjustable bridge members corresponding to each string of the instrument.

BACKGROUND OF THE INVENTION

Adjustable bridges of various types have been utilized with stringed musical instruments for a number of years. Several prior art bridge devices have been proposed which include individual bridge elements corresponding to each string of the instrument. A number of these prior art devices provide for individual adjustment of the bridge elements in one or more directions relative to the strings in order to achieve proper intonation and action adjustment of the strings. Such a mechanism allows the strings to be finely tuned and individually adjusted for personal taste or slight deviations in the trueness of the strings.

For example, Fender, U.S. Pat. No. 3,290,980 describes a bridge construction including a plurality of hardened steel sleeves arranged in end-to-end contacting relationship. The position of each sleeve may be individually adjusted longitudinally with respect to the string by a screw, and the height of the sleeves can be adjusted with respect to the body of the instrument by raising or lowering a supporting bridge section.

Similar devices are disclosed in Fender, U.S. Pat. No. 4,031,799 and Fender, U.S. Pat. No. 4,281,576. In these two references, a plurality of drums are positioned in end-to-end relationship, and each drum may be adjusted in two orthogonal directions so as to separately adjust the length of each string and the height of each string relative to the neck of the instrument. In each of these patents, the height adjustment requires that two separate set screws be adjusted for each drum in order to adjust the height of the string relative to the instrument.

Another prior art approach is disclosed in Schaller, U.S. Pat. No. 4,361,068. In this device, a series of movable pedestals are adjustable in two directions, and a threaded roller allows further adjustment of the string position laterally with respect to the guitar. The individual pedestals may be raised and lowered with respect to the body of the guitar by turning a pair of screws.

Several additional prior art devices are described in patents to Wilson et al., U.S. Pat. No. 4,373,417, McCarty, U.S. Pat. No. 2,714,326, Lieber, U.S. Pat. No. 4,248,126, Shaw et al., U.S. Pat. No. 4,385,543, and Petillo, U.S. Pat. No. 4,128,033.

In general, adjustment of the bridge units in the above prior art devices is somewhat difficult and time-consuming in view of the number of adjustment screws which must be utilized to move the individual bridge elements. In addition, these prior art devices generally do not incorporate a tuning mechanism, since the tuning of the strings in the prior art instruments is typically done at the neck extremity of the instrument, rather than on the body of the instrument.

In addition, these prior art devices generally allow the bridge elements to float, thereby requiring a spring or other biasing means to maintain the bridge element in its general position with respect to the longitudinal adjusting screw. This allows for greater relative motion of the bridge elements and less accurate adjustment of the bridge element position.

Accordingly, it is a primary object of this invention to improve the accuracy and ease of adjustment of a bridge for a stringed musical instrument.

It is a further object of this invention to reduce the number of adjustments which must be made in order to move an individual bridge element in an adjustable bridge.

Yet another object of the invention is to provide positive engagement for individual bridge elements of an adjustable bridge to reduce relative motion thereof.

A still further object of the invention is to combine a tuning mechanism with an adjustable bridge to improve accuracy and convenience in tuning, and for simplifying the replacement of the strings of a stringed musical instrument.

Additional objects and advantages will be set forth in part in the description which follows, and in part will be obvious from the description, or may be learned by practice of the invention.

SUMMARY OF THE INVENTION

To achieve the foregoing objects and in accordance with the purpose of the invention, as embodied and broadly described herein, the adjustable bridge and tuning unit of the present invention is for a stringed musical instrument, the instrument including a body, a neck portion extending from the body, a plurality of strings extending over a part of the body and the neck portion, and means for securing the strings at one end to the neck portion. The bridge and tuning unit comprises a base member fixedly mounted to the body, the base member including a pair of sidewalls defining a channel therebetween. The unit includes a plurality of individual bridge saddles, one of the saddles corresponding to and aligned for supporting each of the strings. Each saddle may generally comprise a rectangular parallelipiped, and has a groove on one surface thereof for alignment with the string. The bridge saddles are positioned in abutting relation within the channel, and one of the saddles is in frictional contact with one of the sidewalls.

The unit also includes first and second angled means for individual bidirectional adjustment of each of the bridge saddles with respect to its corresponding string. The first angled means is for individually adjusting the position of each of the bridge saddles longitudinally in the direction of the string, and the second angled means includes only a single screw for adjusting the position of each of the bridge saddles generally vertically with respect to the base member. Tuning means are mounted to the base member for securing the other end of each of the strings, and for increasing or decreasing the tension in each string.

Preferably, the base member includes means for locking against movement of the saddles in the channel. The locking means preferably includes at least one fastener threaded through the other sidewall for holding the saddles in abutting relation.

It is also preferred that the first angled means include a threaded member and a corresponding threaded bore in each saddle for positive engagement with the saddle, and anchor means for securing one end of each threaded member against longitudinal movement. It is preferred that one end of each of the threaded members be enlarged, and that the tuning means include an angled cover having a plurality of slots therein, the slots for receiving and anchoring the enlarged ends against longitudinal movement.

Each of the bridge saddles preferably includes an insert mounted in the groove, the insert including a recess therein for receiving and supporting the corresponding string. The insert is typically cylindrically-shaped, and the recess surrounds the insert.

Each of the saddles preferably also includes a threaded hole extending through the saddle from the grooved surface to the opposite surface thereof, the hole for receiving the single screw of the second angled means. The single screw and the threaded hole are angled from the grooved surface to the opposite surface for supporting the force of the tension string, and for permitting adjustment of the single screw when the string is in place.

Preferably, the inserts are positioned in the saddles for generally correct intonation and action of the corresponding strings when the bridge saddles are precisely aligned with each other in the two directions, and one of the saddles is aligned with predetermined markings on the unit.

BRIEF DESCRIPTION OF THE DRAWINGS

The accompanying drawings which are incorporated in and constitute a part of this specification, illustrate one embodiment of the invention, and together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

In accordance with the invention, the adjustable bridge and tuning unit is for a stringed musical instrument, the instrument including a body, a neck portion extending from the body, a plurality of strings extending over a part of the body and the neck portion, and means for securing the strings at one end to the neck portion. The bridge and tuning unit comprises a base member fixedly mounted to the body, the base member including a pair of sidewalls defining a channel therebetween. The unit includes a plurality of individual bridge saddles, one of the bridge saddles corresponding to and aligned for supporting each of the strings, and having a groove on one surface thereof for alignment with the string. The bridge saddles are positioned in abutting relation within the channel, and one of the saddles is in frictional contact with one of the sidewalls.

In accordance with the invention, first and second angled means are provided for individual bidirectional adjustment of each of the bridge saddles with respect to the corresponding string. The first angled means is for individually adjusting the position of each of the bridge saddles longitudinally in the direction of the string, and the second angled means includes only a single screw for adjusting the position of each of the bridge saddles generally vertically with respect to the base member. Tuning means are mounted on the base member for securing the other end of each of the strings, and for increasing the tension on each string.

Figure 1:
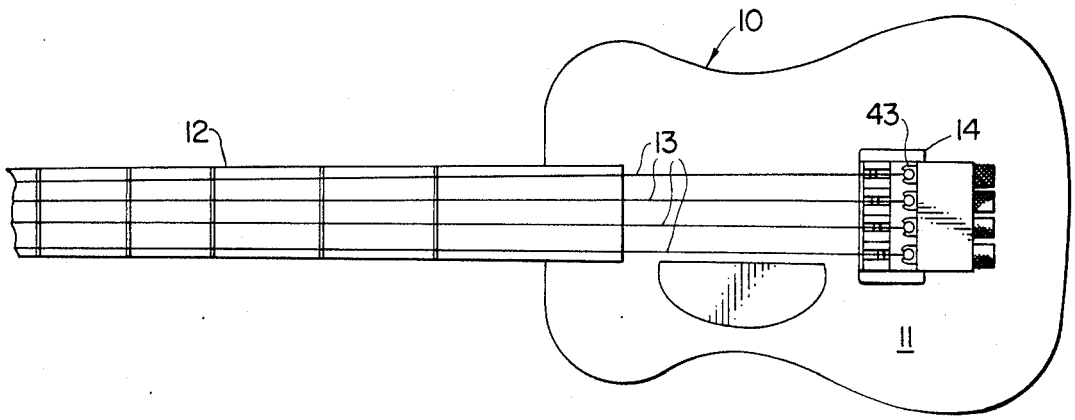
FIG. 1 is a top view of a stringed musical instrument with the bridge and tuning unit mounted thereon.
Figure 2:
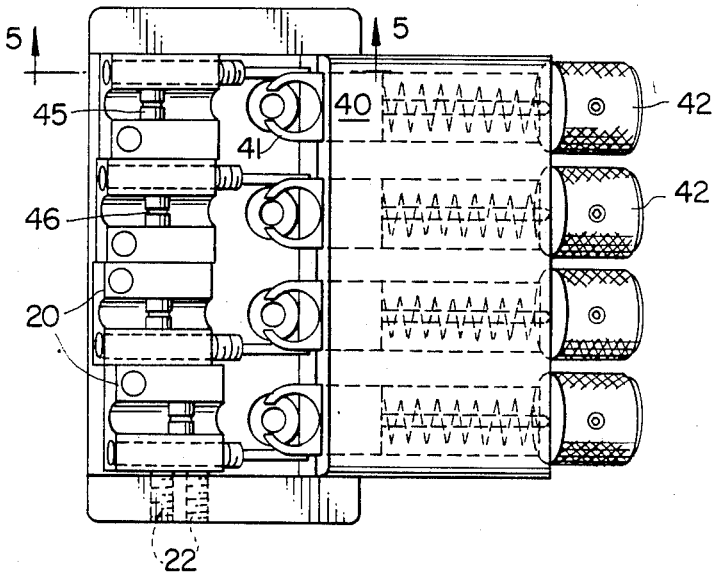
FIG. 2 is an enlarged top view of the bridge and tuning unit of the present invention.

As embodied herein, and as shown in FIGS. 1 and 2, a guitar 10 including a body 11 and a neck portion 12 extending from the body has a plurality of strings 13 mounted thereon. The strings 13 extend over a part of the body 11 and the neck portion 12. Means for securing the strings to the neck portion 12 are provided (not shown). Such securing means could include holes for tying the strings, or other structure, for example, as disclosed in U.S. patent application No. 386,326, filed June 8, 1982, now abandoned in favor of continuation application Ser. No. 656,501 filed Oct. 1, 1984 in the name of Ned Steinberger, the same inventor herein, which disclosure is hereby incorporated by reference.

Figure 3:
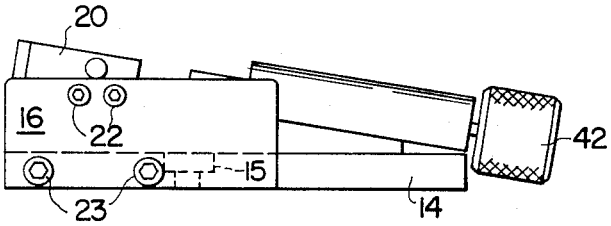
FIG. 3 is a side view of the bridge and tuning unit.

A base member 14 is fixedly mounted to the body. As shown in FIG. 3, the base member 14 may comprise a flat plate formed of metal or other suitable material. The base member 14 is fastened to the body 11 of the instrument 10 by suitable screws or other fasteners. A series of recesses 15 may be provided for this purpose.

Figure 4:
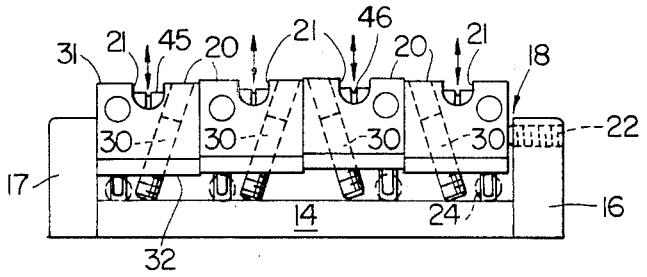
FIG. 4 is a front view of the unit showing the single angled screw for adjusting the position of each saddle.

As best shown in FIGS. 3 and 4, the base member 14 includes a pair of sidewalls 16 and 17 defining a channel 18 therebetween.

A plurality of individual bridge saddles 20 are positioned in abutting position within the channel 18. Each of the saddles 20 corresponds to and is aligned for supporting one of the strings 13. Each saddle 20 preferably generally comprises a rectangular parallelipiped, and has a groove 21 on one surface thereof for alignment with the string 13. The saddles 20 are in frictional contact with the sidewall 17, as shown in FIG. 4. Preferably, means are provided for locking against movement of the saddles in the channel. As embodied herein, the locking means includes at least one fastener 22 threaded through the sidewall 16 for holding the saddles 20 in abutting relation. The sidewalls 16 and 17 may be attached to the base member 14 by suitable screws 23, as shown in FIG. 3.

As embodied herein, the first angled means includes a threaded member 24 and a corresponding threaded bore 25 in each of the saddles 20 for positive engagement with the saddle 20. In accordance with the invention, anchor means are provided for securing one end of each of the threaded members against longitudinal movement. In the illustrated embodiment, the anchor means includes an enlarged portion 27 on one end of the threaded member 24. An angled cover 28 including a plurality of slots 29 is provided for receiving and anchoring the enlarged ends 27 against longitudinal movement. The angled cover 28 may be fastened to the base member 14 by additional screws (not shown), and may include an integral mass 26 for abutting against the ends 27.

Figure 5:
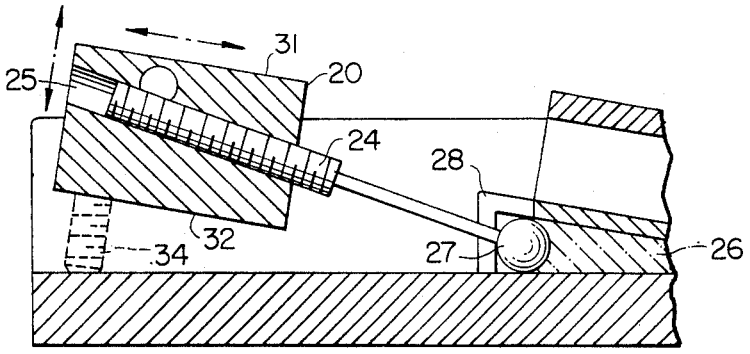
FIG. 5 is a cross-sectional view taken along the line 5—5 of FIG. 2.
Figure 6:
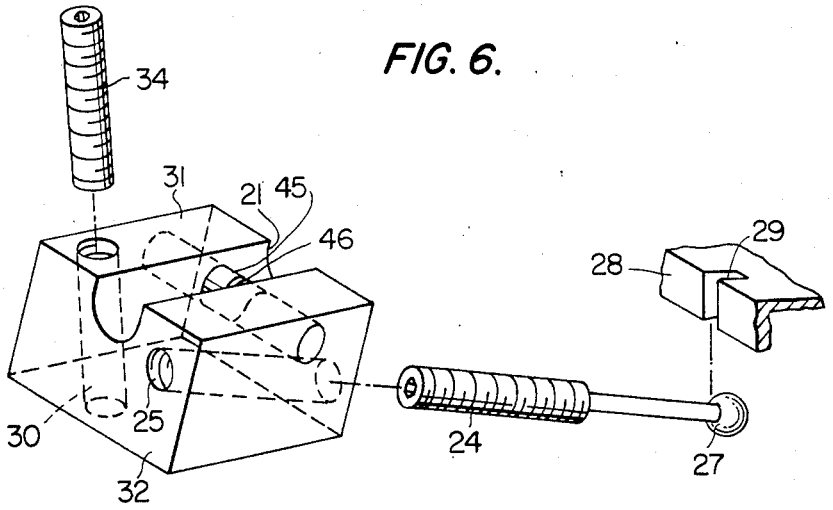
FIG. 6 is an exploded perspective view of an individual bridge saddle of the invention showing the two angled screws and the insert.

As embodied herein, each saddle 20 includes a threaded hole 30 extending through the saddle 20 from the grooved surface 31 to the opposite surface 32. The hole 30 is for receiving a single screw 34 therein. The single screw 34 and the threaded hole 30 are angled from the groove surface 31 to the opposite surface 32 for supporting the force of the tensioned string 13 and for permitting adjustment of the single screw 34 when the string 13 is in place. This angled construction, as shown in FIGS. 4, 5, and 6, allows for simple and rapid adjustment of the height of the string 13 above the body 11. In addition, the angled arrangement makes the head of the screw accessible with the string in place, and allows the screw to bear the brunt of the weight and force of the tensioned string.

As embodied herein, the tuning means comprises a slidable member 40 having a pair of jaws 41 thereon. The member 40 is adjustable by means of a tuning knob 42 which moves the jaws 41 away from or toward the saddle 20. In the illustrated embodiment, a string having a ball 43 on one end is utilized. The ball 43 fits into the jaws 41 and the tuning knob 42 is turned to tighten or loosen the string. This arrangement allows the string to be tightened in direct alignment with its corresponding bridge saddle, thereby reducing distortion or twisting of the string.

Each of the bridge saddles 20 includes an insert 45 mounted in the groove 21. The insert 45 includes a recess 46 therein for receiving and supporting the corresponding string 13. The insert 45 is preferably cylindrically-shaped, and may be formed of metal or other suitable material. The recess 46 typically surrounds the entire insert 45.

In operation, the adjustable bridge and tuning unit allows rapid adjustment of the intonation and action of the instrument. The longitudinal movement of the saddle 20 is accomplished by simply adjusting the threaded member 24. The enlarged end 27 allows member 24 to be rotated while maintaining positive engagement with the saddle 20, without the need for springs or other biasing mechanisms. Vertical adjustment of the saddle 20 with respect to the base member 14 is accomplished by adjusting screw 34. Accordingly, only a single screw need be adjusted for moving the saddle in each direction.

For additional ease and simplicity, the unit may include markings (not shown) for aligning one of the saddles in a predetermined position. For example, lines or other marks may be provided on the sidewall 17 for placing the abutting saddle 20 in the predetermined position. The inserts 45 may be positioned in the saddle 20 for the generally correct intonation and action of the corresponding strings when all of the saddles 20 are precisely aligned in the two adjustable directions with the saddle in the preset position. Any further individual refinements or fine tuning may be quickly accomplished from this preset location. However, the preset position will provide a generally correct setting for each string which could be achieved in a very rapid manner.

Thus, it is believed that the present invention provides a tuning device which is more easily adjusted and which is extremely accurate in comparison with the prior art.

It will be apparent to those skilled in the art the various modifications and variations could be made in the structure of the invention without departing from the scope or spirit of the invention.

What is claimed is:

1. An adjustable bridge and tuning unit for a stringed musical instrument, the instrument including a body, a neck portion extending from the body, a plurality of strings extending over a part of said body and said neck portion, and means for securing said strings at one end to said neck portion, the bridge and tuning unit comprising:

a base member fixedly mounted to said body, the base member including a pair of sidewalls defining a channel therebetween;

a plurality of individual bridge saddles, one of said bridge saddles corresponding to and aligned for supporting each of said strings, each saddle having a string supporting portion including a groove on one surface thereof for alignment with said string, said string passing entirely over said saddle;

said bridge saddles being positioned in abutting relation within said channel, one of said saddles being in frictional contact with one of said sidewalls;

first and second angled means for individual bidirectional adjustment of each said bridge saddle with respect to said corresponding string while said string is in place under tension on said instrument, said first angled means for individually adjusting the position of each said bridge saddle longitudinally in the direction of said string, and said second angled means including only a single screw for adjusting the position of each said bridge saddle generally vertically with respect to said base member, said screw having a top offset from the string supporting portion of said saddle for access to said screw and a bottom located substantially centrally of the width of said bridge saddle; and tuning means mounted on said base member for securing the other end of said string and for increasing or decreasing the tension in each said string.

2. The adjustable bridge and tuning unit of claim 1 wherein said base member includes means for locking against movement of said saddles in said channel.

3. The adjustable bridge and tuning unit of claim 2 wherein said locking means includes at least one fastener threaded through said other sidewall for holding said saddle in said abutting relation.

4. The adjustable bridge and tuning unit of claim 1 wherein said first angled means includes a threaded member and a corresponding threaded bore in each said saddle for positive engagement with said saddle, and anchor means for securing one end of each said threaded member against longitudinal movement.

5. The adjustable bridge and tuning unit of claim 4 wherein said one end of each said threaded member is enlarged, and said tuning means includes an angled cover having a plurality of slots therein, said slots for receiving and anchoring said enlarged ends against longitudinal movement.

6. The adjustable bridge and tuning unit of claim 1 wherein each said bridge saddle generally comprises a rectangular parallelipiped, and includes an insert mounted in said groove, said insert including a recess therein for receiving and supporting said corresponding string.

7. The adjustable bridge and tuning unit of claim 6 wherein said insert is cylindrically-shaped and said recess surrounds said insert.

8. The adjustable bridge and tuning unit of claim 7 wherein said unit includes markings for aligning one of said saddles in a predetermined position, and said inserts are positioned in said saddles for generally correct intonation and action of said corresponding strings when said one saddle is in said predetermined position, and all said other saddles are precisely aligned with said one saddle in said two directions.

9. The adjustable bridge and tuning unit of claim 1 wherein each said saddle includes a threaded hole extending through said saddle from the grooved surface to the opposite surface thereof, said hole for receiving said single screw of said second angled means.

10. The adjustable bridge and tuning unit of claim 9 wherein said single screw and said threaded hole are angled from said grooved surface to said opposite surface for supporting the force of said tensioned string, and for permitting adjustment of said single screw when said string is in place.

* * * * *